US008431296B2

(12) United States Patent
Pang et al.

(10) Patent No.: US 8,431,296 B2
(45) **Date of Patent: *Apr. 30, 2013**

(54) ELECTROPHOTOGRAPHIC TONER, PROCESS FOR PREPARING THE SAME, IMAGE FORMING METHOD AND APPARATUS USING THE TONER

(75) Inventors: Kyeong Pang, Suwon-si (KR); Hae-ree Joo, Anyang-si (KR); Jeong-hyun Lee, Suwon-si (KR); Su-bum Park, Daegu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 596 days.

This patent is subject to a terminal disclaimer.

(21) Appl. No.: 12/500,861

(22) Filed: Jul. 10, 2009

(65) Prior Publication Data

US 2010/0009283 A1 Jan. 14, 2010

(30) Foreign Application Priority Data

Jul. 11, 2008 (KR) ..... 10-2008-0067827
Nov. 13, 2008 (KR) ..... 10-2008-0112874

(51) Int. Cl.
*G03G 9/00* (2006.01)

(52) U.S. Cl.
USPC ..... 430/108.3; 430/108.7; 430/110.2

(58) Field of Classification Search ..... 430/108.1, 430/108.3, 108.4, 108.7, 108.8, 110.2, 110.3
See application file for complete search history.

(56) References Cited

U.S. PATENT DOCUMENTS

| | | | | |
|---|---|---|---|---|
| 6,887,638 | B2 | 5/2005 | Ishiyama et al. | |
| 7,010,257 | B2 | 3/2006 | Someya et al. | |
| 7,901,857 | B2 | 3/2011 | Nakazawa et al. | |
| 8,227,161 | B2 * | 7/2012 | Shin et al. | 430/108.3 |
| 2008/0166649 | A1 * | 7/2008 | Moffat et al. | 430/108.8 |
| 2009/0111038 | A1 * | 4/2009 | Shin et al. | 430/48 |

FOREIGN PATENT DOCUMENTS

| | | |
|---|---|---|
| JP | 2005-173358 | 6/2005 |
| KR | 10-2004-0025812 | 3/2004 |
| KR | 10-2006-0101280 | 9/2006 |

* cited by examiner

*Primary Examiner* — Stewart Fraser
(74) *Attorney, Agent, or Firm* — Staas & Halsey LLP

(57) ABSTRACT

Provided are an electrophotographic toner, a process for preparing the same, image forming method and an image forming apparatus using the toner. The electrophotographic toner may include a latex, colorant, wax, Si and Fe. A molar ratio of Si/Fe may be about 0.1 to about 5.

10 Claims, 1 Drawing Sheet

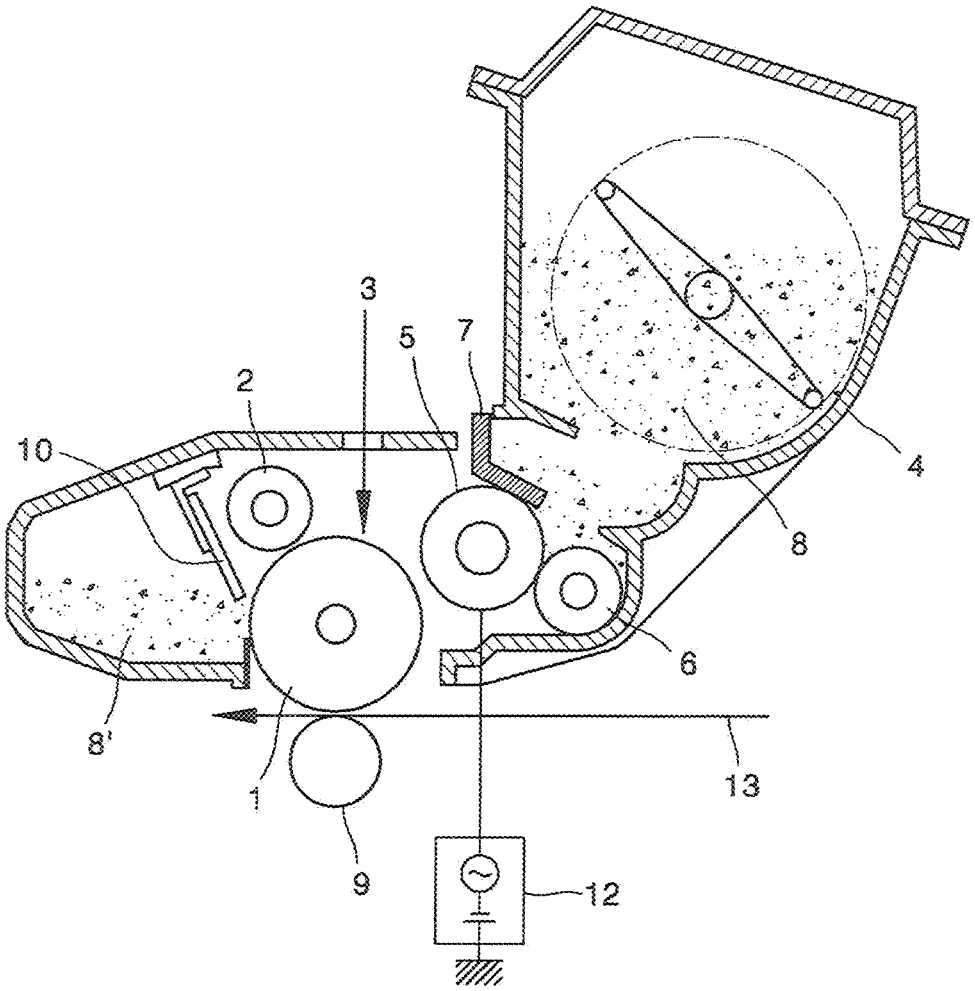
3
5
7
2
10
4
8
6
8'
1
13
9
12

ELECTROPHOTOGRAPHIC TONER, PROCESS FOR PREPARING THE SAME, IMAGE FORMING METHOD AND APPARATUS USING THE TONER

CROSS-REFERENCE TO RELATED PATENT APPLICATION

This application claims the benefit of Korean Patent Application No. 10-2008-0067827, filed on Jul. 11, 2008 and Korean Patent Application No 10-10-2008-0112874, filed on Nov. 13, 2008, in the Korean Intellectual Property Office, the disclosure of which is incorporated by reference herein in its entirety.

TECHNICAL FIELD

This disclosure generally relates to the field of electrophotographic printing. In particular, it is an electrophotographic toner, a process for preparing the same, an image forming method and an image forming apparatus both using the toner.

BACKGROUND

In electrophotographic or electrostatic recording processes, a developer used to form an electrostatic image or an electrostatic latent image can be classified into the following categories: (1) a two-component developer formed of toner and carrier particles; and (2) and a one-component developer formed of toner only. The one-component developer can be further classified into a magnetic one-component developer and a nonmagnetic one-component developer. Fluiding agents such as colloidal silica are often added to the nonmagnetic one-component developer to increase the fluidity of the toner. Typically, coloring particles obtained by dispersing a pigment such as carbon black or other additives in latex are used as the toner.

Methods of preparing toner include pulverization and polymerization. In pulverization, toner is obtained by melting and mixing synthetic resins with pigments and, if required, other additives. This mixture is then pulverized and the particles are sorted until particles of a desired size are obtained. In polymerization, a polymerizable monomer composition is manufactured by uniformly dissolving or dispersing various additives such as a pigment, a polymerization initiator and, if required, a cross-linking agent and an antistatic agent in a polymerizable monomer. Then, the polymerizable monomer composition is dispersed in an aqueous dispersive medium, which includes a dispersion stabilizer. An agitator is used to shape any minute liquid droplet particles. Subsequently, the temperature is increased and suspension polymerization is performed to obtain polymerized toner having colored polymer particles of a desired size.

In an image forming apparatus such as an electrophotographic apparatus or an electrostatic recording apparatus, an image is formed by exposing an image on a uniformly charged photoreceptor to form an electrostatic latent image, attaching toner to the electrostatic latent image to form a toner image, transferring the toner image onto a transfer member such as transfer paper or the like, and then fusing the toner image onto the transfer member using any of a variety of methods, including heating, pressurizing, solvent steaming, and the like. In most fusing processes, the transfer medium with the toner image passes through fusing rollers. By heating and pressing, the toner image is fused to the transfer medium.

Images formed by an image forming apparatus such as an electrophotocopier should satisfy requirements of high precision and accuracy. Conventionally, toner used in an image forming apparatus is obtained by pulverization. In pulverization, color particles having a large range of sizes may be formed. To obtain satisfactory developing properties, the color particles must be sorted according to size to reduce the particle size distribution. However, it is difficult to precisely control the particle size and the particle size distribution using a conventional mixing/pulverizing process in the manufacture of toner suitable for an electrophotographic process or an electrostatic recording process. Also, when preparing a fine-particle toner, the toner preparation yield is adversely affected by the sorting process. In addition, there are limits to changes or adjustments that can be made to the toner design while still obtaining desirable charging and fusing properties.

Using polymerization, the size of particles is easier to control. In addition, these particles do not need to undergo a complex manufacturing process such as sorting. Polymerized toner having a desired particle size and particle size distribution can be obtained without pulverizing or sorting. However, the particle size and shape are not always satisfactorily controlled. In addition, it is not always easy to agglomerate latex and colorant. Further, an aluminum-based material may be used as an agglomerating agent, which is hazardous to human health and the environment. Also, since the toner has a narrower fusing range as the printing speed increases, toner having different fusing properties according to the printing speed, may be needed.

Therefore, there is a need for toner that is efficiently agglomerated, presents little or no risk to humans or the environment, forms images having high glossiness, has a wide fusing range during a high-speed printing operation, has a fine particle size and reduced particle size distribution and has excellent heat preserving and anti-offset properties.

SUMMARY

We provide an electrophotographic toner comprising a latex, a colorant, a wax and about 3 to about 1,000 ppm each of Si and Fe. A molar ratio of Si/Fe may be in the range of about 0.1 to about 5. Fusing properties of the electrophotographic toner satisfy Formulas 1 and 2:

$$\frac{MFT_A}{MFT_B} \geq \frac{HOT_A}{HOT_B} \times 0.8 \qquad \text{Formula 1}$$

$$\frac{MFT_A}{MFT_B} \times Gloss_A \geq \frac{HOT_A}{HOT_B} \times 4 \qquad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted at a rate of about 290 mm/sec. $HOT_A$ is a hot offset temperature in a low-speed printing operation conducted at a rate of about 160 mm/sec. $HOT_B$ is a hot offset temperature in a high-speed printing operation conducted at a rate of about 290 mm/sec. $Gloss_A$ is glossiness measured at an angle of about 60° at a fusing temperature of about 160° C. in a low-speed printing operation conducted at a rate of about 160 mm/sec.

We also provide a method for preparing an electrophotographic toner. The method comprises preparing a first agglomerated toner by mixing first latex particles. The first latex particles comprise a wax with a pigment dispersion. A metal salt of Si and Fe is then added to the mixture. A second agglomerated toner may be prepared by agglomerating fine particles by coating a second latex on the first agglomerated toner. The fusing properties of the electrophotographic toner satisfy Formulas 1 and 2:

$$\frac{MFT_A}{MFT_B} \geq \frac{HOT_A}{HOT_B} \times 0.8 \quad \text{Formula 1}$$

$$\frac{MFT_A}{MFT_B} \times Gloss_A \geq \frac{HOT_A}{HOT_B} \times 4 \quad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted at a rate of about 290 mm/sec. $HOT_A$ is a hot offset temperature in a low-speed printing operation conducted at a rate of about 160 mm/sec. $HOT_B$ is a hot offset temperature in a high-speed printing operation conducted at a rate of about 290 mm/sec. $Gloss_A$ is glossiness measured at an angle of 60° at a fusing temperature of 160° C. in a low-speed printing operation conducted at a rate of about 160 mm/sec.

We also provide a method of forming images. The method comprises attaching a toner to a surface of a photoreceptor on which an electrostatic latent image has been formed to form a visible image and transferring the visible image to a transfer medium. The toner is an electrophotographic toner comprising a latex, a colorant, a wax, and about 3 to about 1,000 ppm each of Si and Fe. A molar ratio of Si/Fe is in the range of about 0.1 to about 5. Fusing properties of the electrophotographic toner satisfy Formulas 1 and 2:

$$\frac{MFT_A}{MFT_B} \geq \frac{HOT_A}{HOT_B} \times 0.8 \quad \text{Formula 1}$$

$$\frac{MFT_A}{MFT_B} \times Gloss_A \geq \frac{HOT_A}{HOT_B} \times 4 \quad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted at a rate of about 290 mm/sec. $HOT_A$ is a hot offset temperature in a low-speed printing operation conducted at a rate of about 160 mm/sec. $HOT_B$ is a hot offset temperature in a high-speed printing operation conducted at a rate of about 290 mm/sec. $Gloss_A$ is glossiness measured at an angle of 60° at a fusing temperature of about 160° C. in a low-speed printing operation conducted at a rate of about 160 mm/sec.

We also provide an image forming device comprising a photoreceptor, an image forming unit that forms an electrostatic latent image on a surface of the photoreceptor, a unit that receives toner, a toner supplying unit that supplies the toner onto the surface of the photoreceptor in order to form a toner image by developing the electrostatic latent image and a toner transferring unit that transfers the toner image to a transfer medium from the surface of the photoreceptor. The toner is an electrophotographic toner comprising a latex, a colorant, a wax, and about 3 to about 1,000 ppm each of Si and Fe. A molar ratio of Si/Fe is in the range of about 0.1 to about 5. Fusing properties of the electrophotographic toner satisfy Formulas 1 and 2:

$$\frac{MFT_A}{MFT_B} \geq \frac{HOT_A}{HOT_B} \times 0.8 \quad \text{Formula 1}$$

-continued $$\frac{MFT_A}{MFT_B} \times Gloss_A \geq \frac{HOT_A}{HOT_B} \times 4 \quad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted at a rate of about 290 mm/sec. $HOT_A$ is a hot offset temperature in a low-speed printing operation conducted at a rate of about 160 mm/sec. $HOT_B$ is a hot offset temperature in a high-speed printing operation conducted at a rate of about 290 mm/sec. $Gloss_A$ is glossiness measured at an angle of 60° at a fusing temperature of 160° C. in a low-speed printing operation conducted at a rate of 160 mm/sec.

We also provide a developing device comprising a photoreceptor, a developing unit that transfers toner onto the surface of the photoreceptor, a toner supplying unit that supplies the toner to the developing unit and a toner storing unit that stores the toner to be supplied to the toner supplying unit. The toner is an electrophotographic toner comprising a latex, a colorant, a wax, and about 3 to about 1,000 ppm each of Si and Fe. A molar ratio of Si/Fe is in the range of about 0.1 to about 5. Fusing properties of the electrophotographic toner satisfy Formulas 1 and 2:

$$\frac{MFT_A}{MFT_B} \geq \frac{HOT_A}{HOT_B} \times 0.8 \quad \text{Formula 1}$$

$$\frac{MFT_A}{MFT_B} \times Gloss_A \geq \frac{HOT_A}{HOT_B} \times 4 \quad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted, at a rate of about 290 mm/sec. $HOT_A$ is a hot offset temperature in a low-speed printing operation conducted at a rate of 160 mm/sec. $HOT_B$ is a hot offset temperature in a high-speed printing operation conducted at a rate of about 290 mm/sec. $Gloss_A$ is glossiness measured at an angle of 60° at a fusing temperature of 160° C. in a low-speed printing operation conducted at a rate of about 160 mm/sec.

BRIEF DESCRIPTION OF THE DRAWINGS

The above and other features and advantages will become more apparent by describing in detail examples thereof with reference to the attached drawing in which FIG. 1 illustrates an image forming apparatus employing toner.

DETAILED DESCRIPTION

The disclosure will now be described more fully. Reference may be made to the accompanying drawing, in which representative example of an image forming apparatus employing toner is shown.

An electrophotographic toner may include a latex, a colorant, a wax and about 3-1,000 ppm each of Si and Fe. A molar ratio of Si/Fe may be in the range of about 0.1 to 5. Fusing properties of the electrophotographic toner may satisfy Formulas 1 and 2:

$$\frac{MFT_A}{MFT_B} \geq \frac{HOT_A}{HOT_B} \times 0.8 \quad \text{Formula 1}$$

-continued $$\frac{MFT_A}{MFT_B} \times Gloss_A \geq \frac{HOT_A}{HOT_B} \times 4 \quad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted at a rate of about 290 mm/sec. $HOT_A$ is a hot offset temperature in a low-speed printing operation conducted at a rate of about 160 mm/sec. $HOT_B$ is a hot offset temperature in a high-speed printing operation conducted at a rate of about 290 mm/sec. $Gloss_A$ is glossiness measured at an angle of about 60° at a fusing temperature of about 160° C. in a low-speed printing operation conducted at a rate of 160 mm/sec. The minimum fusing temperature and the hot offset temperature were measured using a belt-type fusing device having a Nip width of 10 mm, a Nip pressure of 4 kgf and paper (e.g., Exclusive, Xerox™) having a weight of 90 g/m$^2$.

Formulas 1 and 2 show relationships between the minimum fusing temperature ratio and the hot offset temperature ratio of the low-speed and high-speed printings. If toner satisfies the relations represented by Formulas 1 and 2 at the same time, the toner has the required fusing properties regardless of the printing speed of toner. That is, the fusing range of the low-speed fusing operation is not decreased in the high-speed fusing operation. Since the fusing range is stably maintained during the high-speed printing, the same toner may be adequate for both low-speed and high-speed fusing devices.

The fusing properties of the electrophotographic toner may be improved by controlling an agglomeration process. A stable fusing range may be obtained by the anti-offset properties of toner. The anti-offset properties of toner are closely related to the rheological properties of toner. In order to improve the rheological properties of toner, physical properties such as molecular weight of latex and cross-linking density are regulated or wax is used as a releasing agent. However, the fusing range may be reduced in the high-speed fusing process.

An agglomerating agent controls an agglomeration process to improve the Theological properties of toner. Thus, the fusing range in the high-speed printing operation may not be reduced at all or as severely. That is, toner elements such as the latex, the wax, and the colorant may efficiently agglomerate using a metal salt agglomerating agent including Si and Fe at a low temperature using a small amount of the metal salt. Since the rheological properties of toner can be improved by regulating the agglomeration process, a wide fusing range may be obtained during the high-speed printing operation and images having high glossiness often result. In addition, capsule-shaped toner can be prepared by regulating the agglomeration process and, thus, the charging properties may be uniformly regulated. Fluidity and heat preserving properties of the toner may be improved by inhibiting the colorant and pigment from being exposed.

A maximum glossiness difference of the electrophotographic toner between low-speed printing, conducted at a rate of about 160 mm/sec, and high-speed printing, conducted at a rate of about 290 mm/sec, is less than about 3, and preferably in the range of about 0 to 2, when an image is fixed using a belt-type fusing device (such a device may have a nip width of 10 mm, and line pressure of 4 kgf) and a TMA of 0.7±0.03 mg/cm$^2$. Glossiness is measured using a glossmeter (micro-TR1-gloss) at an angle of 60°.

Since a metal salt including Si and Fe is used as an agglomerating agent in the manufacturing process of the electrophotographic toner, the electrophotographic toner includes about 3 to about 1,000 ppm of each of Si and Fe. When the concentration of Si and Fe, respectively, is less than 3 ppm, desired effects may not be obtained. On the other hand, when the concentration of Si and Fe, respectively, is greater than about 1,000 ppm, problems such as charge reduction may occur.

When the electrophotographic toner is measured using a differential scanning calorimeter, a starting point of the highest endothermic peak is in the range of 68 to 75° C., the peak temperature is in the range of 75 to 95° C. and one or two endothermic peaks may be observed.

When the electrophotographic toner is measured using a differential scanning calorimeter, a starting point of the highest endothermic peak is in the range of 68 to 75° C., the peak temperature is in the range of 75 to 95° C. and one or two endothermic peaks may be observed.

When the metal salt including Si and Fe is used as an agglomerating agent in the manufacturing process of the electrophotographic toner, a molar ratio of Si and Fe (Si/Fe) may be in the range of about 0.1 to 5, and preferably about 0.15 to 3. If the molar ratio of Si/Fe is less than 0.1, a reduction in cohesion of toner may result. On the other hand, when the molar ratio of Si/Fe is greater than 5, charge reduction may occur.

Fine-particle toner may be prepared by using a metal salt including Si and Fe as an agglomerating agent and particle size of the toner may be regulated. Accordingly, an average particle size of the toner may be in the range of about 3 to 8 μm, and an average sphericity of the toner is in the range of about 0.940 to 0.970. In particular, the average sphericity difference between toner having the average particle size of 2 μm and 5 μm may be less than 0.02, and thus the particles are more uniform. In particular, PSD(p,v) values may be about 1.25 or less, and preferably from about 1.23 to 1.2.

The electrophotographic toner has a storage modulus G' in the range of about 1E+05 to 1E+07 at about 80° C., and in the range of about 5E+02 to 3E+03 at 140° C. Thus, if the storage modulus G' is less than about 1E+05 at about 80° C., high temperature retention properties (storage stability, thermal endurance, and anti-blocking properties) may not be maintained. If the storage modulus G' is greater than about 1E+07 at 80° C., fusing properties (MFT) may not be maintained. If the storage modulus G' is less than about 5E+02 at about 140° C., anti-hot offset properties may not be maintained. If the storage modulus G' is greater than about 3E+03 at about 140° C., toner may not have high glossiness.

We also provide a process for preparing an electrophotographic toner whereby agglomeration of toner can be efficiently achieved by using a metal salt including Si and Fe as an agglomerating agent.

The process includes: preparing a first agglomerated toner by mixing first latex particles including a wax, with a pigment dispersion, and adding a metal salt including Si and Fe to the mixture; and preparing a second agglomerated toner by coating a second latex prepared by polymerizing one or more polymerizable monomers, on the first agglomerated toner.

It is believed that the size of the first agglomerated toner is made larger by increased ionic strength resulting from the addition of the metal salt, including Si and Fe, and collisions between the particles during the process for manufacturing the toner. An example of the metal salt is polysilica iron. In particular, products of 주식회사 수도가공 (영문명을 알려주세요) (Model Nos. PSI-025, PSI-050, PSI-075, PSI-100, PSI-200 and PSI-300) can be used. Properties and compositions of PSI-025, PSI-050, PSI-075, PSI-100, PSI-200, and PSI-300 are listed in Table 1 below.

TABLE 1

| | PSI-025 | PSI-050 | PSI-075 | PSI-100 | PSI-200 | PSI-300 |
|---|---|---|---|---|---|---|
| Molar ratio of Silica/Fe (Si/Fe) | 0.25 | 0.5 | 0.75 | 1 | 2 | 3 |
| Concentration of Fe(wt %) | 5.0 | 3.5 | 2.5 | 2.0 | 1.0 | 0.7 |
| main component $SiO_2$(wt %) | 1.4 | 1.9 | 2.0 | 2.2 | | |
| pH (1 w/v %) | 2-3 | | | | | |
| Specific gravity (20° C.) | 1.14 | 1.13 | 1.09 | 1.08 | 1.06 | 1.04 |
| Viscosity (mPa · S) | 2.0 or higher | | | | | |
| Mean molecular weight (Dalton) | 500,000 | | | | | |
| Appearance | Yellowish brown transparent liquid | | | | | |

The first latex particles may be polyester. In particular, they may be a polymer obtained by polymerizing one or more polymerizable monomers or a mixture thereof (a hybrid type). When the polymer is used as the first latex particles, the polymerizable monomers can be polymerized with a wax, or a wax can be added to the polymer. A wax-containing latex having a particle size of about 1 μm or less, and preferably in the range of about 100 to 300 nm. can be prepared by emulsion polymerization.

The polymerizable monomer may be at least one monomer selected from the group consisting of styrene-based monomers such as styrene, vinyl toluene and α-methyl styrene; acrylic acid or methacrylic acid; derivatives of (metha)acrylates such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and metacryl amide; ethylenically unsaturated monoolefins such as ethylene, propylene and butylene; halogenized vinyls such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone.

The wax used in the process of preparing the first latex or toner functions to allow the toner to be fixed on a final image receptor at a low temperature and have excellent durability and wear resistance. Examples of the wax are polyethylene-based wax, polypropylene-based wax, silicone wax, paraffin-based wax, ester-based wax, carbauna wax and metallocene wax, but are not limited thereto. In particular, the wax used in the toner may have a melting point in the range of about 50 to about 150° C. Components of the wax may physically adhere to toner particles, but do not covalently bond to the toner particles.

The amount of wax may be about 0 to about 20 parts by weight based on 100 parts by weight of the toner. When the amount of wax is greater than about 20 parts by weight based on 100 parts by weight of the toner, the manufacturing costs may increase. The wax may be added to the process of preparing the latex, or to the agglomeration process in a dispersed state.

A polymerization initiator and a chain transfer agent may be used in the process of preparing the first latex to improve the efficiency of the polymerization. Examples of the polymerization initiator are persulfate salts such as potassium persulfate and ammonium persulfate; azo compounds such as 4,4-azobis(4-cyano valeric acid), dimethyl-2,2'-azobis(2-methyl propionate), 2,2-azobis(2-amidinopropane)dihydrochloride, 2,2-azobis-2-methyl-N-1, 1-bis(hydroxymethyl)-2-hydroxyethylpropioamide, 2,2'-azobis(2-4-dimethyl valeronitrile), 2,2'-azobis isobutyronitrile and 1,1'-azobis(1-cyclohexanecarbonitrile); and peroxides such as methyl ethyl peroxide, di-t-butylperoxide, acetyl peroxide, dicumyl peroxide, lauroyl peroxide, benzoyl peroxide, t-butylperoxy-2-ethyl hexanoate, di-isopropyl peroxydicarbonate and di-t-butylperoxy isophthalate. Also, an oxidization-reduction initiator in which the polymerization initiator and a reduction agent are combined, may be used.

A chain transfer agent is a material that converts a type of chain carrier in a chain reaction. A new chain has generally much less activity than that of a previous chain. The polymerization degree of the monomer can be reduced and new chains can be initiated using the chain transfer agent. In addition, a molecular weight distribution can be adjusted using the chain transfer agent.

Examples of the chain transfer agent are sulfur containing compounds such as dodecanthiol, thioglycolic acid, thioacetic acid and mercaptoethanol; phosphorous acid compounds such as phosphorous acid and sodium phosphite; hypophosphorous acid compounds such as hypophosphorous acid and sodium hypophosphite; and alcohols such as methyl alcohol, ethyl alcohol, isopropyl alcohol and n-butyl alcohol, but are not limited thereto.

The first latex particles may further include a charge control agent. The charge control agent used herein may be a negative charge type charge control agent or a positive charge type charge control agent. The negative charge type charge control agent may be an organic metal complex or a chelate compound such as an azo dye containing chromium or a mono azo metal complex; a salicylic acid compound containing metal such as chromium, iron and zinc; or an organic metal complex of an aromatic hydroxycarboxylic acid and an aromatic dicarboxylic acid. Moreover, any known negative charge type charge control agent may be used without limitation. The positive charge type charge control agent may be a modified product such as nigrosine and a fatty acid metal salt thereof and an onium salt including a quaternary ammonium salt such as tributylammonium 1-hydroxy-4-naphthosulfonate and tetrabutylanmonium tetrafluoro borate which may be used alone or in combination of at least two. Since the charge control agent stably supports toner on a developing roller by electrostatic force, charging may be performed stably and quickly using the charge control agent.

The prepared first latex may be mixed with a pigment dispersion. The pigment dispersion can be prepared by homogeneously dispersing a composition including pigments such as black, cyan, magenta and yellow and an emulsifier using a ultrasonic processor, Micro fludizer, or the like.

Carbon black or aniline black may be used as the pigment for a black toner, and for color toner, at least one of yellow, magenta and cyan pigments are further included.

A condensation nitrogen compound, an isoindolinone compound, an anthraquine compound, an azo metal complex or an allyl imide compound can be used as the yellow pigment. In particular, C.I. pigment yellow 12, 13, 14, 17, 62, 74, 83, 93, 94, 95, 109, 110, 111, 128, 129, 147, 168, 180, or the like can be used.

A condensation nitrogen compound, an anthraquine compound, a quinacridone compound, a base dye lake compound, a naphthol compound, a benzo imidazole compound, a thioindigo compound or a perylene compound can be used as the magenta pigment. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like can be used.

A copper phthalocyanine compound and derivatives thereof, an anthraquine compound, or a base dye lake compound can be used as the cyan pigment. In particular, C.I. pigment blue 1, 7, 15, 15:1, 15:2, 15:3, 15:4, 60, 62, 66, orthe like can be used.

Such pigments can be used alone or in a combination of at least two pigments, and are selected in consideration of color, chromacity, luminance, resistance to weather, dispersion capability in toner, etc.

The amount of pigment as described above may be about 0.1 to 20 parts by weight based on 100 parts by weight of the first latex. The amount of pigment should be sufficient to color the toner; however, when the amount of the pigment is less than about 0.1 parts by weight based on 100 parts by weight of the first latex, the coloring effect is not sufficient. On the other hand, when the amount of the pigment is greater than about 20 parts by weight based on 100 parts by weight of the first latex, the manufacturing costs of toner increase, and thus a sufficient amount of frictional charge cannot be obtained.

Any emulsifier that is known in the art may be used as an emulsifier in the pigment dispersion. In this regard, an anionic reactive emulsifier, a nonionic reactive emulsifier or a mixture thereof can be used. The anionic reactive emulsifier may be HS-10 (Dai-ich kogyo, Co., Ltd.), Dawfax 2-A1 (Dow Chemical Company), etc., and the nonionic reactive emulsifier may be RN-10 (Dai-ichi kogyo, Co., Ltd.).

The prepared first latex particles including wax and the pigment dispersion are mixed and then the agglomerating agent including Si and Fe is added to the mixture to prepare agglomerated toner. More particularly, the first latex particles including a wax and the pigment dispersion are mixed, the agglomerating agent including Si and Fe is added to the mixture at a pH of 1 to 4. This forms a first agglomerated toner having an average particle size of about 2.5 μm or less, which becomes a core of the toner. Then, a second latex is added to the resultant, and the pH is adjusted to 6 to 8. When the particle size is constantly maintained for a certain period of time, the resultant is heated to a temperature in the range of about 90 to 96° C., and the pH is adjusted to 5.8 to 6 to prepare a second agglomerated toner.

The second latex may be prepared by polymerizing one or more polymerizable monomers described above. The polymerizable monomers are emulsion polymerized to prepare latex having a particle size of less than about 1 μm; preferably in the range of about 100 to 300 μm. The second latex may also include a wax and the wax may be added to the second latex in the polymerization process.

A third latex prepared by polymerizing one or more polymerizable monomers described above may be coated on the second agglomerated toner.

By forming a shell layer with the second latex and/or the third latex, durability can be improved, which reduces storage problems during shipping and handling.

The prepared second agglomerated toner or third agglomerated toner is filtered to separate toner particles and the toner particles are dried. The dried toner particles are subjected to a surface treatment process using silica or the like, and charge amount is controlled to prepare a final dry toner.

The molecular weight, Tg and rheological properties of the first latex particles formed in the core of toner prepared according to the method described above may be adjusted to efficiently fix toner particles at a low temperature.

The volume average diameter of the prepared toner particles may be in the range of about 3 to 8 μm and preferably about 5 to about 8 μm. When the volume average diameter of the toner particles is less than about 3 μm, problems of cleaning a photoreceptor and a reduction in yield may occur. On the other hand, when the volume average diameter of the toner particles is greater than about 8 μm, charging cannot be uniformly performed, fusing properties of the toner may be decreased, and a Dr-Blade cannot regulate the toner layer.

We further provide a method of forming images. This includes: attaching the toner to a surface of a photoreceptor on which an electrostatic latent image, which forms a visible image. The visible image is then tranferred to a transfer medium. The toner is an electrophotographic toner including a latex, a colorant, a wax and about 3-1,000 ppm of each of Si and Fe. The molar ratio of Si/Fe is in the range of about 0.2 to 0.8, and the fusing properties of the electrophotographic toner satisfy Formulas 1 and 2:

$$\frac{MFT_A}{MFT_B} \geq \frac{HOT_A}{HOT_B} \times 0.8 \qquad \text{Formula 1}$$

$$\frac{MFT_A}{MFT_B} \times Gloss_A \geq \frac{HOT_A}{HOT_B} \times 4 \qquad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted at a rate of about 290 mm/sec. $HOT_A$ is a hot offset temperature in a low-speed printing operation conducted at a rate of about 160 mm/sec. $HOT_B$ is a hot offset temperature in a high-speed printing operation conducted at a rate of about 290 mm/sec, and $Gloss_A$ is glossiness measured at an angle of 60° at a fusing temperature of about 160° C. in a low-speed printing operation conducted at a rate of about 160 mm/sec.

A representative electrophotographic image forming process may include forming images on a receptor, including charging, exposure to light, developing, transferring, fusing, cleaning, and erasing.

In the charging process, a surface of a photoreceptor is charged with negative or positive charges, whichever is desired, by a corona or a charge roller. In the light exposing process, an optical system, conventionally a laser scanner or an array of diodes, selectively discharges the charged surface of the photoreceptor in an imagewise manner corresponding to a final visual image formed on a final image receptor to form a latent image. The optical system uses electromagnetic radiation, also referred to as "light", which can be infrared light irradiation, visible light irradiation, or ultra-violet light irradiation.

In the developing process, suitably charged toner particles generally contact the latent image of the photoreceptor, and conventionally, an electrically-biased developer having identical potential polarity to the toner polarity is used. The toner particles move to the photoreceptor and are selectively attached to the latent image by electrostatic force to form a toner image on the photoreceptor.

In the transferring process, the toner image is transferred to the final image receptor from the photoreceptor, and sometimes, an intermediate transferring element is used to aid the transfer of the toner image from the photoreceptor to the final image receptor.

In the fusing process, the toner image of the final image receptor is heated and the toner particles thereof are softened or melted, thereby fusing the toner image to the final image receptor. In another fusing method, the toner is fused on the final image receptor with high pressure by applying or not applying heat.

In the cleaning process, the residual toner remaining on the photoreceptor is removed.

Finally, in the erasing process, charges of the photoreceptor are exposed to light of a predetermined wavelength band and are reduced to be substantially uniform and of low value, and thus the residue of the organic latent image is removed and the photoreceptor is prepared for a next image forming cycle.

We further provide an image forming device including: a photoreceptor; a developing unit that transfers toner onto the surface of the photoreceptor; a toner supplying unit that supplies the toner to the developing unit; and a toner storing unit that stores the toner to be supplied to the toner supplying unit. The toner maybe an electrophotographic toner including a latex, a colorant, a wax, and about 3 to about 1,000 ppm of each of Si and Fe. A molar ratio of Si/Fe may be in the range of about 0.1 to about 5, and fusing properties of the electrophotographic toner satisfy Formulas 1 and 2:

$$\frac{MFT_A}{MFT_B} \geq \frac{HOT_A}{HOT_B} \times 0.8 \quad \text{Formula 1}$$

$$\frac{MFT_A}{MFT_B} \times Gloss_A \geq \frac{HOT_A}{HOT_B} \times 4 \quad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted at a rate of about 290 mm/sec. $HOT_A$ is a hot offset temperature in a low-speed printing operation conducted at a rate of about 160 mm/sec. $HOT_B$ is a hot offset temperature in a high-speed printing operation conducted at a rate of about 290 mm/sec. $Gloss_A$ is glossiness measured at an angle of 60° at a fusing temperature of 160° C. in a low-speed printing operation conducted at a rate of about 160 mm/sec.

We still further provide an image forming apparatus including: an organic photoreceptor; an image forming unit that forms an electrostatic latent image on a surface of the organic photoreceptor; a unit that receives toner; a toner supplying unit that supplies the toner onto the surface of the organic photoreceptor in order to form a toner image by developing the electrostatic latent image; and a toner transferring unit that transfers the toner image to a transfer medium from the surface of the organic photoreceptor. The toner may be an electrophotographic toner including a latex, a colorant, a wax, and about 3 to about 1,000 ppm of each of Si and Fe. The molar ratio of Si/Fe is in the range of about 0.1 to about 5, and fusing properties of the electrophotographic toner satisfy Formulas 1 and 2:

$$\frac{MFT_A}{MFT_B} \geq \frac{HOT_A}{HOT_B} \times 0.8 \quad \text{Formula 1}$$

$$\frac{MFT_A}{MFT_B} \times Gloss_A \geq \frac{HOT_A}{HOT_B} \times 4 \quad \text{Formula 2}$$

$MFT_A$ is a minimum fusing temperature in a low-speed printing operation conducted at a rate of about 160 mm/sec. $MFT_B$ is a minimum fusing temperature in a high-speed printing operation conducted at a rate of about 290 mm/sec. $HOT_A$ is a hot offset temperature in a low-speed printing operation conducted at a rate of about 160 mm/sec. $HOT_B$ is a hot offset temperature in a high-speed printing operation conducted at a rate of about 290 mm/sec. $Gloss_A$ is glossiness measured at an angle of 60° at a fusing temperature of 160° C. in a low-speed printing operation conducted at a rate of about 160 mm/sec.

FIG. 1 illustrates an image forming apparatus employing toner prepared according to an embodiment of the disclosure.

Referring to FIG. 1, a developer 8, which is a nonmagnetic one-component developer contained in a developing unit 4, is supplied to a developing roller 5 through a feeding roller 6 formed of an elastic material such as a polyurethane foam or sponge. The developer 8 supplied to the developing roller 5 reaches a contact point between the developing roller 5 and a developer regulation blade 7 as the developing roller 5 rotates. The developer regulation blade 7 is formed of an elastic material such as a flexible metal or rubber. When the developer 8 passes the contact point between the developing roller 5 and the developer regulation blade 7, the developer 8 is smoothed to form a thin layer that is sufficiently charged. The developing roller 5 transfers the thin layer of the developer 8 to a developing domain of a photoreceptor 1 where the thin layer of the developer 8 is developed on an electrostatic latent image of the photoreceptor 1, which is a latent image carrier. The electrostatic latent image is formed by scanning light 3 onto the photoreceptor 1.

The developing roller 5 and the photoreceptor 1 face each other with a predetermined distance therebetween. The developing roller 5 rotates counterclockwise and the photoreceptor 1 rotates clockwise.

The developer 8 transferred to the developing domain of the photoreceptor 1 forms a toner image by developing an electrostatic latent image on the photoreceptor 1 according to the intensity of the electric charge generated due to a difference between an AC voltage superposed with a DC voltage applied to the developing roller 5 and a latent image potential of the photoreceptor 1 that is charged by a charging unit 2.

The developer 8 developed on the photoreceptor 1 is transferred to a transferring means 9 as the photoreceptor 1 rotates. The developer 8 developed on the photoreceptor 1 is transferred to a sheet of paper 13 by a corona discharge or a roller to which a high voltage having opposite polarity to that of the developer 8 is applied as the paper 13 passes through the developer 8 developed on the photoreceptor 1, and thus an image is formed.

The image transferred to the printing paper 13 is fused to the printing paper 13 when it passes through a high-temperature and high-pressure fusing device (not shown). Meanwhile, developer 8' remaining on the developing roller 5 and which is not developed is transferred back to the feeding roller 6 contacting the developing roller 5. The remaining developer 8' that is undeveloped on the photoreceptor 1 is collected by a cleaning blade 10. The above processes are repeated.

The disclosure will be described in more detail with reference to the examples below, but is not limited thereto. The following examples are for illustrative purposes only and are not intended to limit the scope of the disclosure.

EXAMPLE 1

Synthesis of Latex

A monomer mixture including 970 g of styrene, 192 g of n-butyl acrylate, and 36 g of b-carboxyethyl acrylate (Sipomer, Rhodia), 4.2 g of A-decane diol diacrylate as a cross-linking agent, and 18.8 g of dodecane diol as a chain transfer agent (CTA) were added to a 3 L beaker. 500 g of sodium dodecyl sulfate (Aldrich) aqueous solution (2 wt % based on water) as an emulsifier was added to the beaker, and the mixture was stirred to prepared a monomer emulsion. 300 g of 5% KPS aqueous solution as an initiator and 650 g of sodium dodecyl sulfate (Aldrich) aqueous solution (0.13 wt % based on water) as the emulsifier were added to a double jacketed reactor which was heated to 75° C. The monomer emulsion was gradually added to the double jacketed reactor while stirring for over 2 hours. The mixture was reacted at the same temperature for 8 hours to prepare latex. The particle size of the prepared latex, which was measured using a light scattering method using Horiba 910, was 150-200 nm.

EXAMPLE 2

Preparation of Pigment Dispersion 10 of a mixture of an anionic reactive emulsifier (HS-10; Dai-ich kogyo, Co., Ltd.) and a nonionic reactive emulsifier (RN-10; Dai-ich kogyo, Co., Ltd.) in weight ratios shown in Table 2 below, 60 g of pigment (black, cyan, magenta, and yellow), and 400 g of glass beads having a diameter of 0.8-1 mm were added to a milling bath. Then, the mixture was milled at room temperature to prepare a dispersion using a ultrasonic homogenizer.

TABLE 2

| Color | Pigment | HS-10:RN-10 (Weight ratio) | Conditions |
|---|---|---|---|
| | | 100:0 | K-A |
| Black | Mogul-L | 80:20 | K-B |
| | | 0:100 | K-C |
| | | 100:0 | Y-A |
| Yellow | PY-74 | 50:50 | Y-B |
| | | 0:100 | Y-C |
| | | 100:0 | M-A |
| Magenta | PR-122 | 50:50 | M-B |
| | | 0:100 | M-C |
| | | 100:0 | C-A |
| Cyan | PB 15:4 | 80:0 | C-B |
| | | 70:30 | C-C |

EXAMPLE 3

Agglomeration and Preparation of Toner 500 g deionized water, 150 g of the first latex for a core, 35 g of the cyan pigment dispersion (HS-10 100%), and 27 g of a wax dispersion P-280 (중경유치(영문명을 알려줍세요)) were added to a 1 L reactor. A mixture of 15 g of PSI-025 (주식회사 수도키공 (영문명을 알려줍세요)) and 15 g of nitric acid (0.3 mol) was added to the reactor. The mixture was stirred at 11,000 rpm for 6 minutes using a homogenizer to prepare a first agglomerated toner having particles with a diameter of 1.5-2.5 μm. The resultant was added to a IL double jacketed reactor, and heated from room temperature to 50° C. (Tg of the latex-5° C.) at a rate of 0.5° C. per minute. When the particle size is about 5.8 μm, 50 g of the second latex prepared by polymerizing styrene-based polymerizable monomer was added thereto. When a volume average diameter (D50) of the particles reached 6.0 μm, NaOH (1 mol) was added thereto to adjust the pH to 7. When the D 50 of the particles was constantly maintained for 10 minutes, the temperature was increased to 96° C. at a rate of 0.5° C./min. When the temperature reached 96° C., 0.3 mol of nitric acid was added thereto to adjust the pH to 6.6. Then, the resultant was agglomerated for 3-5 hours to obtain a second agglomerated toner having a particles with a diameter of 5-6 μm in a potato-shape. Then, the second agglomerated toner was cooled to a temperature lower than Tg, filtered to be separated, and dried.

The dried toner particles were subjected to a surface treatment by adding 0.5 parts by weight of NX-90 (Nippon Aerosil), 1.0 parts by weight of RX-200 (Nippon Aerosil), and 0.5 parts by weight of SW-100 (Titan Kogyo), and the mixture was stirred in a mixer (KM-LS2K, Dae Hwa Tech Co., Ltd.) at 8,000 rpm for 4 minutes. As a result, toner having D50 of 5.9 was obtained.

EXAMPLE 4

Toner was prepared in the same manner as in Example 3, except that a cyan pigment was used instead of the black pigment.

EXAMPLE 5

Toner was prepared in the same manner as in Example 3, except that a magenta pigment was used instead of the black pigment.

EXAMPLE 6

Toner was prepared in the same manner as in Example 3, except that a yellow pigment was used instead of the black pigment.

Comparative Example 1

Cyan toner (Model No. 5440) manufactured by Konica Minolta Holdings, Inc. was used.

Comparative Example 2

Black Toner (Model No. C4300) manufactured by Konica Minolta Holdings, Inc. was used.

Comparative Example 3

Magenta toner (Model No. C4300) manufactured by Konica Minolta Holdings, Inc. was used.

Evaluation of Fusing Range of Toner

Device: belt-type fusing device

Image for test: 100% pattern

Test temperature: 100 to 250° C. (10° C. interval)

Speed: 160 mm/sec (for 26 ppm), 290 mm/sec (for 45 ppm)

Dwell time: 0.08 sec

Tests were conducted under the conditions described above and the properties of fused images were evaluated as follows.

Optical density (OD) of a fused image was measured. 3M 810 tape was attached to the image and the tape was rubbed 5 times using 500 g weight. After the tape was removed, OD of the image was measured.

$$\text{Fixation rate (\%)} = (\text{OD of image after removing tape} / \text{OD of image before removing tape}) \times 100.$$

A region having a fixation rate greater than 90% is regarded as the fusing range of toner.

MFT: minimum fusing temperature [minimum temperature exhibiting a fixation rate greater than 90% without cold-offset].

HOT: hot offset temperature [minimum temperature at which hot-offset occurs].

Evaluation of Glossiness of Toner

Glossiness was measured using a glossmeter at each fusing temperature using the above-mentioned fusing device.

Angle: 60°

Pattern: 100% pattern

Evaluation of storage properties at high temperature 100 g of toner was subjected to surface treatment, supplied to a developing device, sealed, and stored in a constant temperature-humidity oven under conditions as follows:

23° C., 55% RH (relative humidity) 2 hr

=40° C., 90% RH 48 hr

=50° C., 80% RH 48 hr

=40° C., 90% RH 48 hr

=23° C., 55% RH 6 hr

After stored, caking of toner in the developing device was observed with the naked eye, and 100% images were printed. The quality of the images was observed, and the results are shown in Table 3 below.

Temperature sweep: device: TA ARES, temperature increase rate: 2° C./min, 40-180° C., frequency: 6.28 rad/s.

Frequency sweep: device: TA ARES, temperature: 140° C., frequency 0.1-100 rad/s.

The storage modulus G' of the temperature sweep of toner prepared according to Examples 3 to 6 was respectively 2E+05 to 3E+05 Pa·s at 80° C. and 5E+02~2E+03 Pa·s at 140° C.

The slope of linear regions in the frequency sweep curve was −0.4 to −0.2 at 140° C.

A metal salt agglomerating agent including Si and Fe is used to agglomerate toner. Thus, toner can efficiently agglomerate at a low temperature using a small amount of the metal salt agglomerating agent, and an organic color pigment such as rhodamine pigment, which does not easily agglomerate, can agglomerate. In addition, risks that aluminum remaining in conventional agglomerating agents harms humans and the environment can be excluded. According to the agglomeration process regulation, capsule-shaped toner can be prepared, and thus the charging properties may be uniformly regulated and fluidity and heat preserving properties of toner may be improved by inhibiting the colorant and pigment from being exposed. Furthermore, since the fusing properties of toner are not sensitively affected by the printing speed, toner can have stable fusing properties in a high-speed printing operation, and thus toner for both low-speed and high-speed fusing devices can be prepared.

TABLE 3

| | $MFT_A$ (° C.) | $MFT_B$° C. (° C.) | $HOT_A$ (° C.) | $HOT_B$ (° C.) | $Gloss_A$ | $Gloss_B$ | $Latitude_A$ | $Latitude_B$ | storage properties at high temperature |
|---|---|---|---|---|---|---|---|---|---|
| Example 3 | 130 | 150 | 250 | 250 | 7.3 | 6.1 | 120 | 100 | ○ |
| Example 4 | 140 | 150 | 250 | 250 | 8.2 | 7.4 | 110 | 100 | ○ |
| Example 5 | 140 | 150 | 250 | 250 | 7.5 | 6.1 | 110 | 100 | ○ |
| Example 6 | 120 | 140 | 250 | 250 | 10.7 | 7.0 | 130 | 110 | ○ |
| Comparative Example 1 | 140 | 175 | 250 | 240 | 3.2 | 1.9 | 110 | 65 | Δ |
| Comparative Example 2 | 130 | 170 | 240 | 220 | 4.4 | 3.1 | 110 | 50 | x |
| Comparative Example 3 | 130 | 180 | 200 | 200 | 5.5 | 3.7 | 70 | 20 | x |

—: Reference of evaluation

○: Good image quality, No-Caking

Δ: Poor image quality, No-Caking x: Caking $MFT_A$: minimum fusing temperature in a low-speed printing operation conducted at a rate of about 160 mm/sec (26 ppm).

$MFT_B$: minimum fusing temperature in a high-speed printing operation conducted at a rate of about 290 mm/sec (45 ppm).

$HOT_A$: hot offset temperature in a low-speed printing operation conducted at a rate of about 160-mm/sec (26 ppm).

$HOT_B$: hot offset temperature in a high-speed printing operation conducted at a rate of about 290 mm/sec (45 ppm).

$Gloss_A$: glossiness measured in a low-speed printing operation conducted at a rate of about 160 mm/sec (26 ppm) (at an angle of 60° at a fusing temperature of 160° C.).

$Gloss_B$: glossiness measured in a high-speed printing operation conducted at a rate of about 290 mm/sec (45 ppm) (at an angle of 60° at a fusing temperature of 160° C.).

$Latitude_A$: $HOT_A - MFT_A$ $Latitude_B$: $HOT_B - MFT_B$

As shown in Table 3 above, toner prepared according to Examples 3 to 6 has excellent storage properties at high temperature and excellent glossiness, and the glossiness difference between low-speed printing and high-speed printing is less than 1. Thus, it can be seen that the toner according to Examples 3 to 6 satisfies Formulas 1 and 2.

The rheological properties of toner were measured using a temperature sweep in which the temperature is programmed to increase at constant frequency and a frequency sweep in which the frequency is programmed to change at constant temperature. The conditions are as follows.

While the disclosure has been particularly shown and described with reference to representative examples thereof, it will be understood by those of ordinary skill in the art that various changes in form and details may be made therein without departing from the spirit and scope of the disclosure as defined by the following claims.

What is claimed is:

1. An electrophotographic toner comprising:

a latex, a colorant, a wax; and a metal salt including Si and FE, wherein the electrophotographic toner has about 3 to about 1,000 ppm each of Si and Fe, and having a molar ratio of Si/Fe of about 0.1 to about 5, wherein fusing properties of the electrophotographic toner satisfy Formulas 1 and 2:

$$\frac{MFT_A}{MFT_B} \geq \frac{HOT_A}{HOT_B} \times 0.8, \quad \text{Formula 1}$$

$$\frac{MFT_A}{MFT_B} \times Gloss_A \geq \frac{HOT_A}{HOT_B} \times 4, \quad \text{Formula 2}$$

wherein $MFT_A$ is a minimum fusing temperature in a low-speed printing operation conducted at a rate of about 160 mm/sec, wherein $MFT_B$ is a minimum fusing temperature in a high-speed printing operation conducted at a rate of about 290 mm/sec, wherein $HOT_A$ is a hot offset temperature in a low-speed printing operation conducted at a rate of about 160 mm/sec, wherein $HOT_B$ is a hot offset temperature in a high-speed printing operation conducted at a rate of about 290 mm/sec, and wherein $Gloss_A$ is glossiness measured at an angle of about 60° at a fusing temperature of about 160° C. in a low-speed printing operation conducted at a rate of about 160 mm/sec.

2. The electrophotographic toner of claim 1, wherein a maximum glossiness difference of the electrophotographic toner between low-speed printing and high-speed printing is less than 1 when an image is fused.

3. The electrophotographic toner of claim 1, wherein when the electrophotographic toner is measured using a differential scanning calorimeter, a starting point of the highest endothermic peak is in the range of about 68° C. to about 75° C. and the peak temperature is in the range of about 75° C. to about 95° C.

4. The electrophotographic toner of claim 1, having an average particle diameter in the range of about 3 μm to about 8 μm.

5. The electrophotographic toner of claim 1, having an average sphericity in the range of about 0.940 to about 0.970.

6. The electrophotographic toner of claim 1, wherein an average sphericity difference between electrophotographic toner having an average particle diameter of about 2 μm and about 5 μm is less than about 0.020.

7. The electrophotographic toner of claim 1, having a $PSD_v$ and a $PSD_p$ less than about 1.25.

8. The electrophotographic toner of claim 1, comprising no more than about 20 parts by weight of the wax based on 100 parts by weight of the toner.

9. The electrophotographic toner of claim 1, wherein the latex is comprised of a first latex particle as a core, the first latex particle comprised of the wax, colorant, Si and Fe and wherein the latex is comprised of a second latex particle as a shell, wherein the second latex particle is coated on the first latex particle.

10. The electrophotographic toner of claim 9, wherein the shell of the latex is comprised of a third latex particle coated on the second latex particle.

* * * * *

UNITED STATES PATENT AND TRADEMARK OFFICE

CERTIFICATE OF CORRECTION

PATENT NO. : 8,431,296 B2
APPLICATION NO. : 12/500861
DATED : April 30, 2013
INVENTOR(S) : Kyeong Pang et al.

It is certified that error appears in the above-identified patent and that said Letters Patent is hereby corrected as shown below:

In the Specifications

In Col. 1, Line 11, Delete "10-10-2008-0112874," and insert -- 10-2008-0112874, --, therefor.

In the Claims

In Col. 16, Line 61, In Claim 1, delete "FE," and insert -- Fe, --, therefor.

In Col. 17, Line 11, In Claim 1, delete "$MFT_B$" and insert -- $MFT_B$, --, therefor.

In Col. 17, Line 17, In Claim 1, delete "$HOT_B$" and insert -- $HOT_B$, --, therefor.

In Col. 17, Line 20, In Claim 1, delete "$Gloss_A$" and insert -- $Gloss_A$, --, therefor.

Signed and Sealed this
Eighth Day of October, 2013

Teresa Stanek Rea

Teresa Stanek Rea
*Deputy Director of the United States Patent and Trademark Office*